United States Patent [19]

De Brouwer

[11] 4,197,671

[45] Apr. 15, 1980

[54] KINEMATIC OPTICAL DEVICE

[76] Inventor: Walter W. De Brouwer, 305 Norwegian Ave., Modesto, Calif. 95350

[21] Appl. No.: 830,186

[22] Filed: Sep. 2, 1977

[51] Int. Cl.[2] ..... A63H 33/28

[52] U.S. Cl. ..... 46/226; 40/444; 46/37; 46/47; 272/8 D

[58] Field of Search ..... 46/47, 37; 272/8 P, 272/8 R, 8 D; 350/274; 40/433, 435, 442, 444, 474

[56] References Cited

U.S. PATENT DOCUMENTS

| | | | |
|---|---|---|---|
| 1,717,785 | 6/1929 | Kaehni et al. | 272/8 P X |
| 2,818,767 | 1/1958 | Hoo | 46/47 X |
| 3,080,474 | 3/1963 | Allen | 272/8 P X |
| 3,465,470 | 9/1969 | Jordan | 272/8 P X |
| 3,564,760 | 2/1971 | McGannon | 46/47 |

*Primary Examiner*—F. Barry Shay
*Attorney, Agent, or Firm*—J. L. Bohan

[57] ABSTRACT

This invention relates to a kinematic art form and amusement device that produces a wide variety of pleasing visual illusions through the combination of a rotating patterned body and pulsating light source.

4 Claims, 13 Drawing Figures

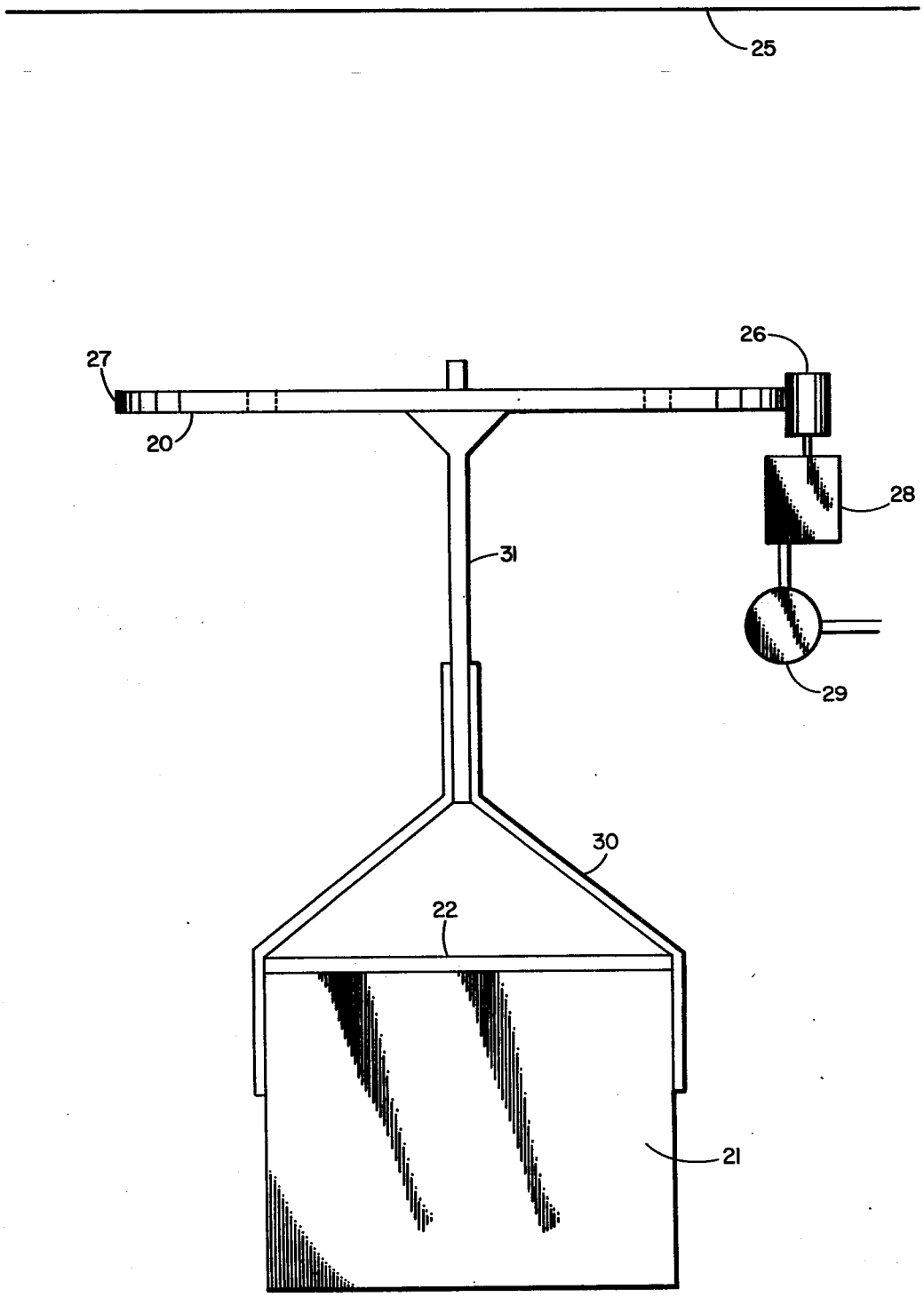
FIG 2-A

KINEMATIC OPTICAL DEVICE

FIELD OF INVENTION

The present invention relates to optical amusement devices in general and the particular devices requiring motion so as to produce the desired illusion. One type of optical illusion device is that shown in U.S. Pat. No. 3,564,760, issued to Patrick J. McGannon on Feb. 23, 1971. The illusion produced by this device calls upon the use of two counter rotating members, one being opaque and the other transparent, thereby creating specialized types of illusions upon rotation of said members which illusions are directly observable by the eye. Another type of optical device calls for the use of reflected patterns projected through slits in a rotating disc edge. The disc is rotated, and the pattern printed on the back of the disc is observed through the slits. However, the pattern rotational speed varies directly with the interruption of images causing no pattern variation. Such a device is shown in U.S. Pat. No. 2,818,767, issued to Paul Soo Hoo on Jan. 7, 1958. Another type of optical device is shown in U.S. Pat. No. 3,272,506, issued on Sept. 13, 1966, to G. W. Lesher. The devices disclosed therein create an apparent emination of colors by the selected movement of bodies containing black and white markings when viewed directly by the eye in visible light. As will be shown hereinafter, the foregoing devices do not teach the specialized form of kinesmatic optical illusion created by the device of the present invention.

SUMMARY OF THE INVENTION

The preferred embodiment of the present invention employs a disc containing perforations circumferentially spaced in accordance with a specific pattern or design so as to produce unusual and intriguing motions upon viewing in a pulsating light field. The illusion created depends upon the image retaining properties of the retina of the eye. As is well known, the human retina will retain an image for a small fraction of a second, and, accordingly, motion pictures are possible by virtue of showing sequential frames at the rate of 16 to 24 frames per second. Between each frame the light is blocked thereby creating darkness on the screen, however, due to the retinal retention of the image the black screen is not perceived, since the image from the next frame is them projected prior to the dissipation of the prior image on the retina. The same is true with regard to the images perceived on a television screen, since the electron scan creates a complete image on the screen followed by total darkness and then a new image prior to the impression of the previous image being lost by the retina. The motion picture industry in the United States has standardized at 24 frames per second so that each second 24 pulses of light are provided and 24 intermediate periods of blackness are created. The television industry in the United States, however, has standardized at the rate of 30 frames per second, thereby creating 30 light pulses broken by 30 intervals of darkness.

By using a preferred embodiment of the present invention wherein a disc containing perforations in a described pattern is viewed in front of a television screen, the pattern will produce the desired optical illusion during rotation of the disc. The pattern may be consistently repeated by rotating the disc at a constant speed or the pattern may be modified in a continuous manner by varying the speed of rotation of the disc. The patterns which may be used are virtually endless in variety and the intriguing optical impressions produced thereby are likewise virtually endless in their variety and complexity. During the rotation of the disc at variable speeds before the pulsating light source, designs can be created that will give the appearance of several rows basically concentric to one another, first rotating in opposite directions, then rotating in the same direction, then reversing their previous directions, and so forth. At the same time, during these reversals in patterns, various optical effects within each region of illusion can be created, such as, blinking, overlays, spirals, undulations, bursts, etc. The overall visual effects that can be produced are too numerous to catalog and many variations will occur to those skilled in the art once the principles of the invention are understood by practicing the invention as described in detail hereinafter.

BRIEF DESCRIPTION OF THE DRAWINGS

FIG. 2-A is a side view of a motor driven projector for use with the rotating member of the present invention.

DETAILED DESCRIPTION

Figure 1:
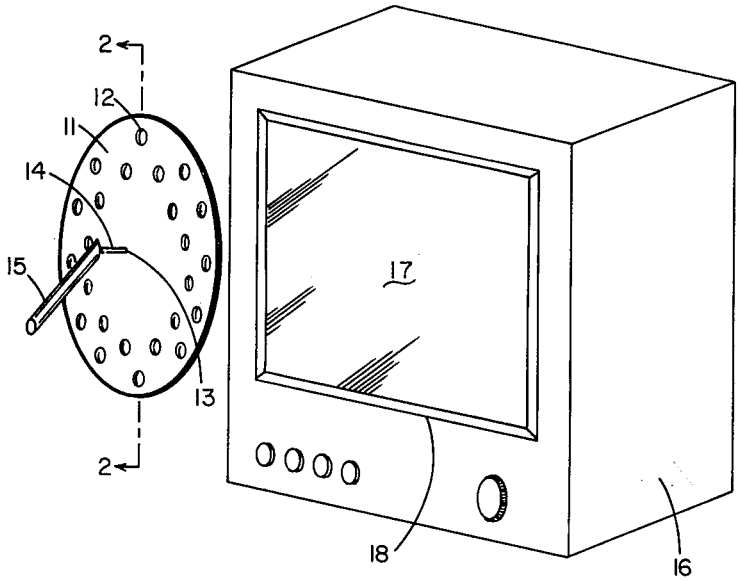
FIG. 1 is a perspective view showing the present invention in combination with a standard television screen as a pulsating light source.

Referring by numerals to the accompanying drawings which illustrate a preferred embodiment of the present invention, in FIG. 1 rotating body 11 contains numerous perforations, such as, 12 in a pattern derived through the teachings herein. Body 11 is rotated about central hole 13 fitted to axle 14. The body 11 is rotated in a clockwise or counter-clockwise direction by spinning it with one hand while holding handle 15 with the other hand. The television set 16 is turned on so as to produce a normal raster pattern 17 on the screen 18 of the television set. It is preferable to tune the television set to a channel which contains no program, thereby creating an effective pulsating light source. In the United States the standard pulsating rate for television screen is 30 times per second, however, it is to be understood that other pulsating rates can be used without acting in derogation of the intriguing optical effects created by the present invention. Moreover, other pulsating light sources can be used, such as, a movie screen or wall illuminated by a standard moving picture projector containing no film so as to produce a pulsating rate somewhere between 18 and 24 pulses per second. Another popular source for pulsating light is a stroboscope which can produce intense bursts of light at any rate desired or at variable rates.

Figure 2:
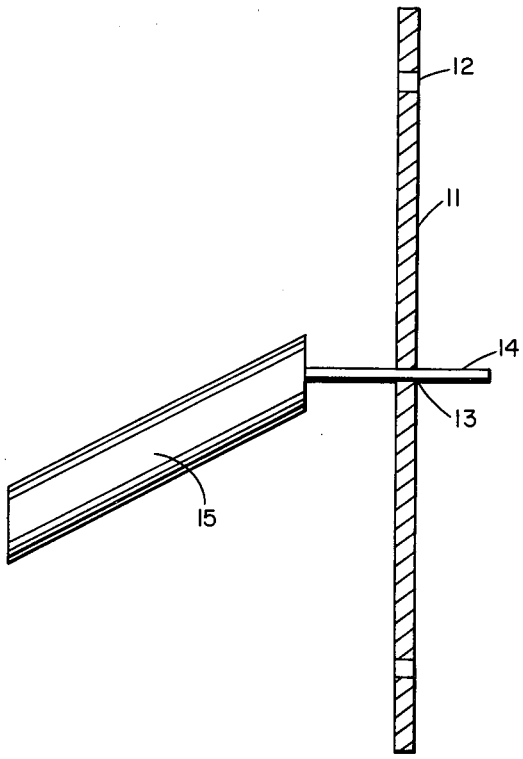
FIG. 2 is a vertical cross-sectioned view taken on line 1—1 of FIG. 1.

Referring now to FIG. 2 there is shown in cross-section the body 11 showing as an example perforation 12 therein. A central perforation 13 in body 11 accommodates axle 14 which is simply a metallic rod fitted to fairly close tolerances with perforation 13 so as to minimize wobbling of body 11 during rotation. To facilitate holding body 11 during rotation, the axle 14 is provided with a handle 15 which is sufficiently far back from the surface of the body 11 so as not to materially obstruct the viewing thereof. Although the easiest method of using the present invention is to employ the perforated bodies in conjunction with a television screen so as to view the pulsating light source through the perforations, as shown in FIG. 1, it is possible to project a light source through the perforations thereby projecting their pattern upon a screen or ceiling. Moreover, as shown in FIG. 2-A, such a device can be provided with a motor drive mechanism which can rotate the body at the preferred rotational speed or at variable rotational speeds. This device shown in FIG. 2-A, employs a pulsating light source 21 containing lens 22 which projects light through the perforation contained in body 20 and onto the screen or ceiling 25 above. Friction drive pulley 26 causes body 20 to rotate by maintaining firm contact with edge 27 of body 20. Motor 28 drives pulley 26 at either a constant speed or, by means of adjusting well-known voltage varying means 29, the speed of the motor can be caused to continuously increase and decrease so as to vary the patterns projected on surface 25. Suitable structures for holding body 20 in position may be provided, such as, the brace 30 and axle 31 configuration.

Figure 3:
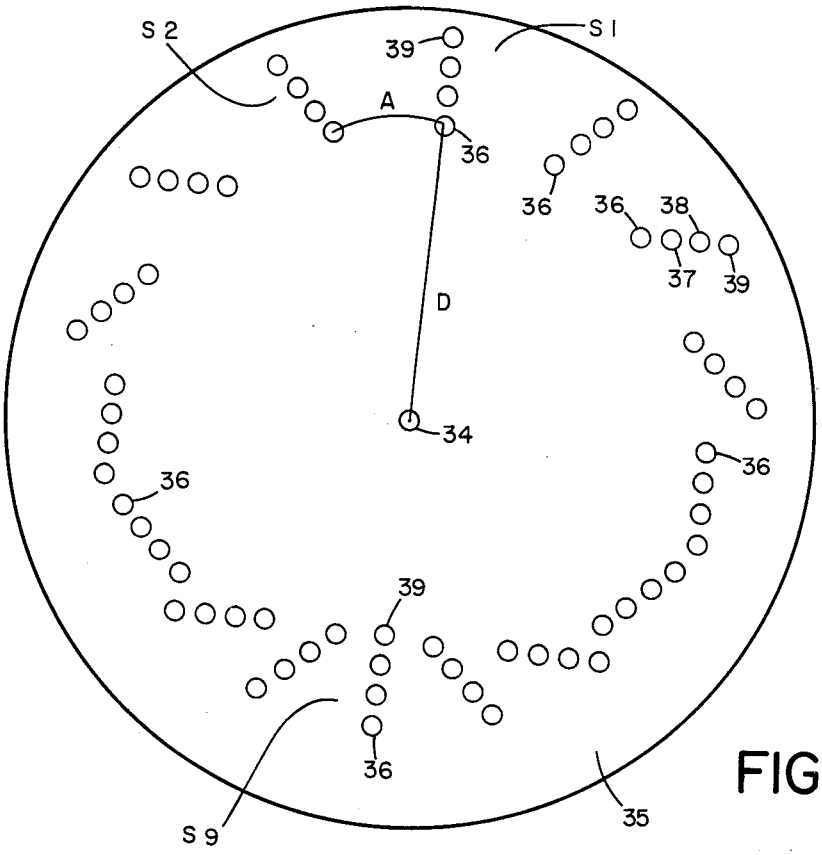
FIG. 3 is an elevation view of the rotating member containing a pattern which will produce a series of rotational or clock configurations.
Figure 4:
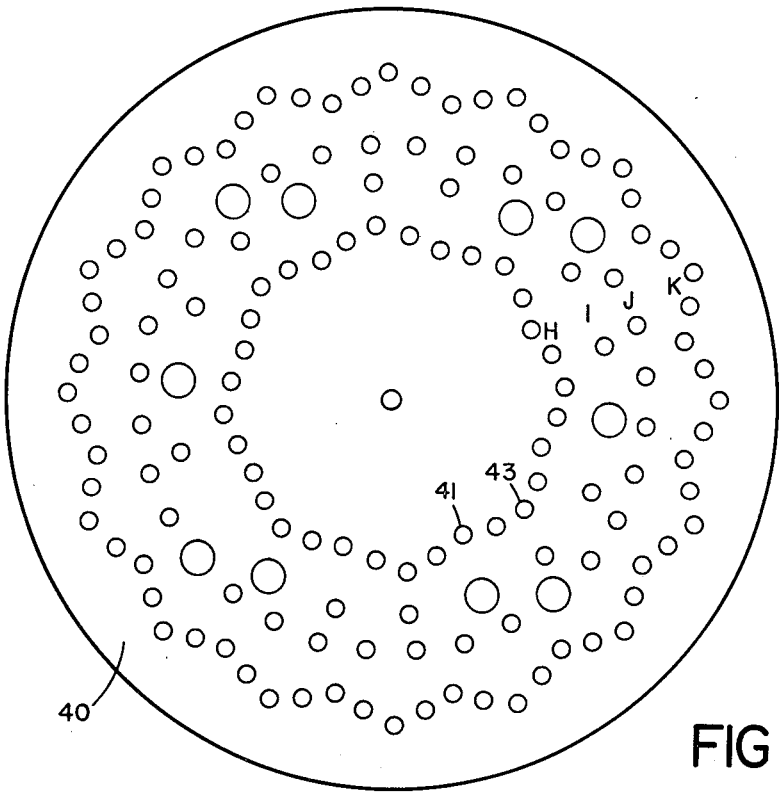
FIG. 4 shows a pattern which will produce various concentric rows of patterns having an undulating or sawtooth effect.

The patterns which may be employed in the rotating body are virtually unlimited. By a body approximately 8 inches in diameter it is possible to employ several pattern variations simultaneously so as to produce highly unusual combined effects. However, for the sake of demonstrating several of these specific types of illusory effects, reference is now made to several specific pattern types. The pattern depicted in FIG. 3 will create the illusion of a plurality of small clock faces having a hand which faces first rotate in one direction and then another. Moreover, the specific positions of the clocks with respect to one another will likewise migrate around the circumference of the body 35 during rotation. If the body 35 is rotated by hand in front of a T.V. screen, the illusion is constantly changing while the speed of the disc decreases. Sixteen sets of clocks are shown in FIG. 3, each of which has a center perforation 36, that during the illusion is the center of rotation of the hands created by perforations 37, 38 and 39. The center of each perforation 36 for each of the 16 sets is located equadistant from the center 34. This distance from the center of 34 to the center of each hole number 36 along a radius is referred herein to as the radial distance, as will become apparent hereinafter in describing the various patterns. There is a definite regime to be followed in order to create the precise effect. For the sake of describing the general position of the various perforations, two coordinates will be referred to herein. One coordinate will be a distance from the center along a radius, defined hereinabove as the radial distance, and will also be referred to herein as the radial coordinate. Moreover, the holes will be circumferentially spaced in which case the radius drawn between two adjacent holes will define an angle. Accordingly, each hole will have a specific degree coordinate as well as a radial coordinate. It will be apparent in studying the pattern in FIG. 3 that all holes 36 are centered on a single concentric circle at a radial distance of D. Since there are 16 sets throughout the 360° of circumference of this concentric circle, the degree coordinate A is 22.5° when proceeding from set S1 to set S2. The three holes 37, 38 and 39 which create the hand of a single clock set swing about hole 36 in a progressive manner from one set to the next. It will be noted that hole 39 in set 1 is the hole having the longest radial distance of all the holes on the board, and a perforation 39 in set S9 has the shortest radial distance of all the perforations on the board. Concentric circles drawn at these two radial distances will define between them the area of action of this particular design. It is obvious that the area inside of this can be used for other patterns which will be described below. By increasing the diameter of the disc further patterns can be placed outside the area of activity of the rotating clock. Since this particular pattern acts within the bounds of the two aforementioned concentric circles, it can be referred to as in a captive area, since it does not wander outside the confines of these two concentric circles. Referring now to FIG. 4, there are shown basically four rows of perforations, namely, rows H, I, J and K. Careful observation will show that in row H perforation No. 41 has the shortest radial distance of that row whereas perforation 43 has the farthest radial distance of that row. Accordingly, concentric circles at these radial distances will define the area in which this row will function to create a specific saw tooth effect upon rotation. Row K likewise operates within a captive area defined by two concentric circles. Use of this pattern in conjunction with a pulsating light source pulsating at a constant rate, will produce a varied effect during rotation at various speeds. A single row can create over a dozen different designs at different speeds and at times various patterns are created by virtue of interactions between the rows. During variable speed rotation of body 40, the various rows will appear to be different distances from each other at different speeds rotating in different directions, stopping at various times and in general creating a wide variety of intriguing illusions. By varying the radial distance, the captive area, the number of holes, the size of holes, and other parameters this saw edge design can produce varied undulating effects and other intriguing illusions of almost endless variety.

Figure 5:
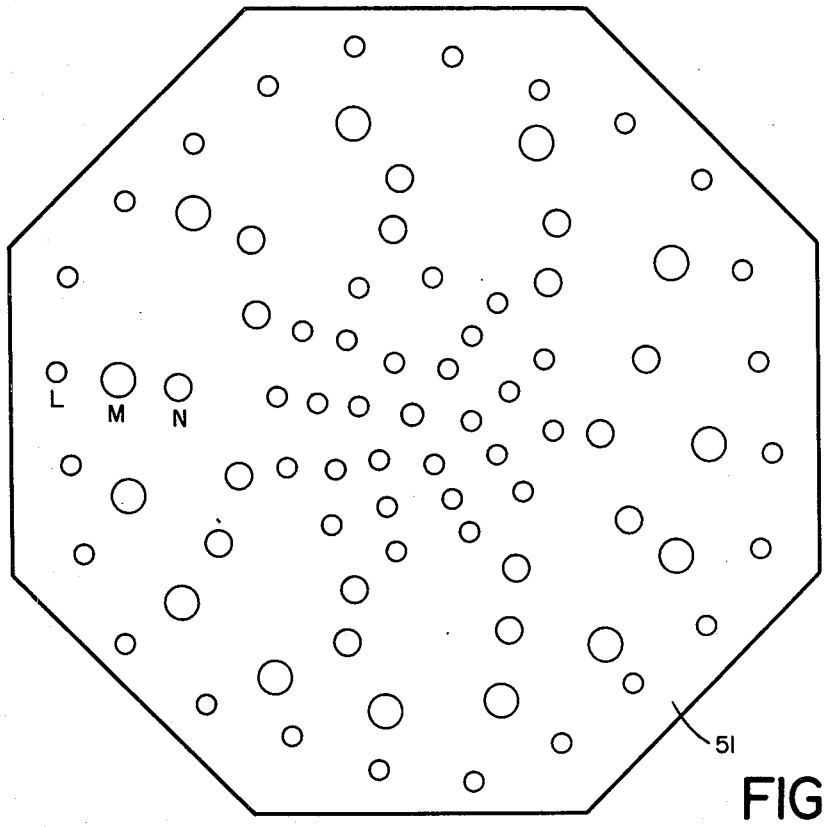
FIG. 5 contains a pattern of concentric rows that will rotate in various directions.
Figure 6:
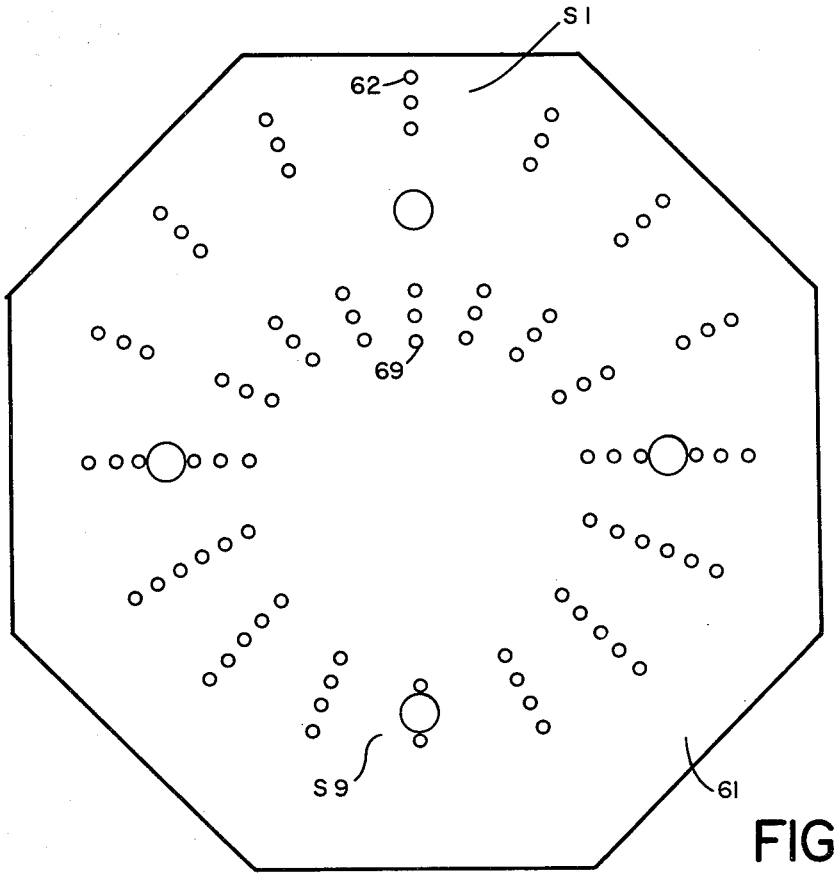
FIG. 6 depicts a pattern which will create a bouncing effect giving the illusion of hammering and pinching.

Referring now to FIG. 5, numerous rows are shown exemplary at the outer edge are rows L, M and N. Outer row L has perforations at various radial distances thereby creating a captive area of activity. However, row M has perforations all of which are equa-distant from the center, therefore having an equal radial distance. Accordingly, instead of working within a captive area, they work along a finite area or line or, in other words, along a line of a single concentric circle. Hence, the area of activity of row M does not extend beyond the outer edges of perforations in that row and, accordingly, instead of being referred to as operating in a captive area, it is referred to as operating in a finite area. However, in order to impart a variable effect with the row-type design, the perforations may be drilled slightly off the concentric finite line or uniformly spaced so as to have uniform degree coordinates or with non-uniform degree coordinates. Moreover, within one row perforations may be of different diameter and all these effects can be varied so as to produce an extremely large number of variable illusions and designs during the rotation of the body 51. FIG. 5 shows the body 51, which is octagonal, thereby creating an illusion effect along the edge while viewing in pulsating light. When the body 51 is rotated at variable speeds in conjunction with a pulsating light source, the rows move rapidly in various directions, then some will slow down, stop and change direction, others will undulate and produce variable other optical effects. It is preferable that from one row to the next there be a different number of holes if interaction between rows is to be minimized. FIG. 6 depicts a hole pattern which will produce a bouncing effect. Body 61 is a design which operates within a captive area since the limits of activity are defined by the concentric circles drawn through perforations 62 and 69 of set S1. With a constant rate pulsating light source and a variable speed of rotation, this body will produce a number of fascinating and intriguing pattern forms at the various speeds by virtue of the pattern contained therein. At certain speeds the optical effect is one of bouncing while at other speeds the illusion is one of a hammering effect. The holes will appear to be moving in a linear fashion along various radials and the perforations are laid out in such a manner as to create the illusion that the perforations or groups of perforations are travelling from the outer edge to near the center and then back to the outer edge again. At certain speeds a double-bounce effect will be noticed and the overall pattern will be noted to rotate first in one direction and then in another direction. This reversal, of course, can happen several times if a sufficient range of rotational speeds are used. Since this pattern works within a captive area on the body 61, this pattern can likewise be used in conjunction with other patterns either closer to the center or at a greater radial distance provided a body of greater diameter is used.

Figure 7:
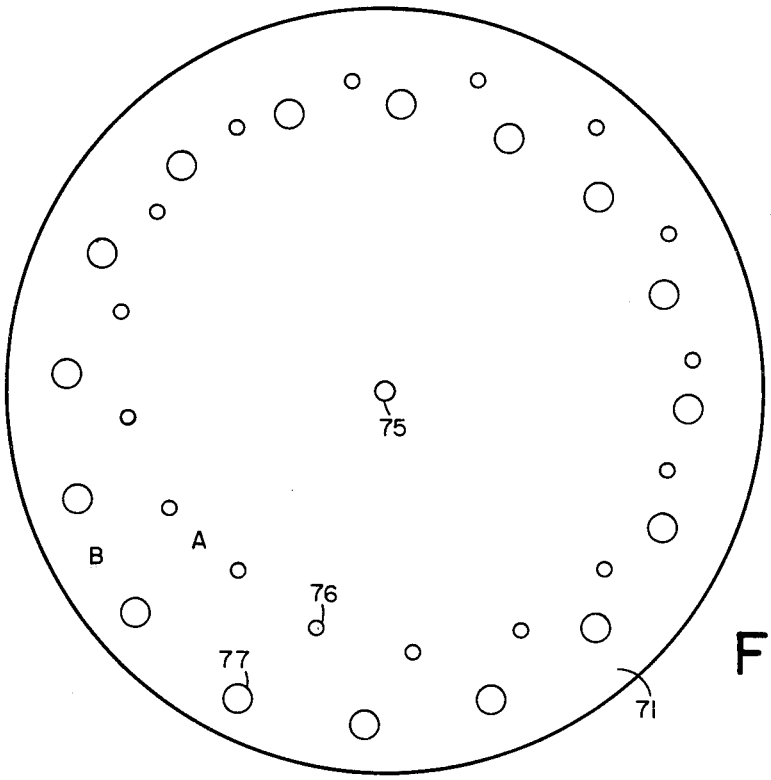
FIG. 7 contains a pattern which will create the illusion of two eccentric circles passing through each other.
Figure 8:
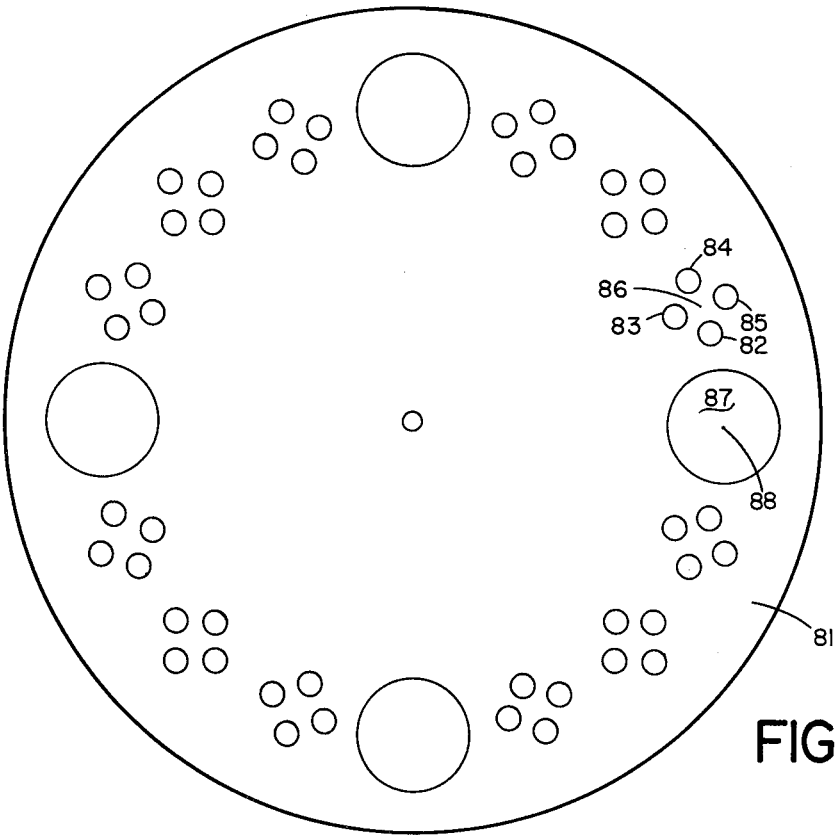
FIG. 8 shows a pattern which will create an overlay effect as well as a linked pattern effect.
Figure 9:
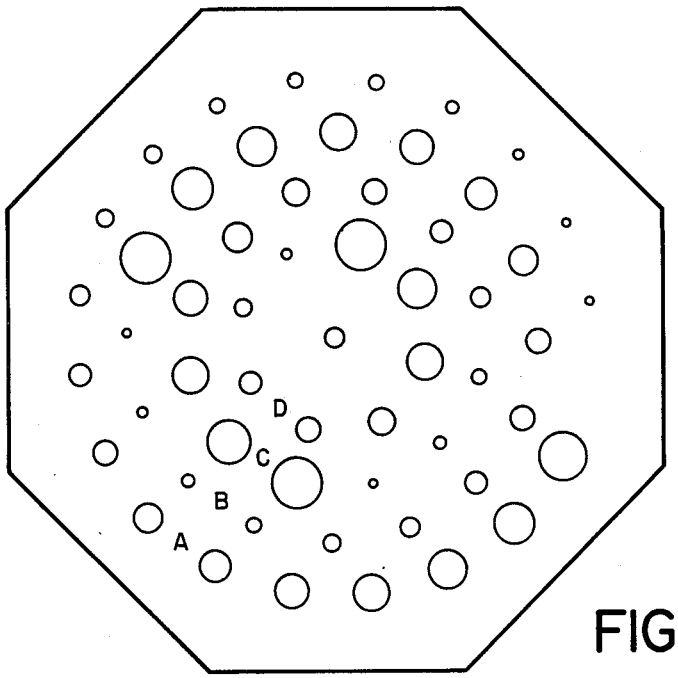
FIG. 9 sets forth a pattern which will result in a blinking illusion.

Referring now to FIG. 7, two rows A and B are basically circular rows of perforations along a finite circle, which circle, however, is not concentric since the radial distance to the various holes in row A is variable. Accordingly, this system uses a variable radial coordinate with uniform separations for locating the perforations. Row B is likewise a series of perforations creating a circle which is not concentric since it likewise has variable radial coordinates just as with row A radial coordinates. The center of each of the two circles defined by rows A and B is approximately equidistant from the central perforation 75 and said centers are approximately 180° apart from each other on each side of said central perforation 75. During the course of rotating body 71 at variable rotational speeds in the presence of a pulsating light source, the illusion is created that one row is passing through the other and that during the various rotational speeds the rows will rotate in various directions. Although the rows are not concentric, the area of activity is defined between two concentric circles drawn through perforations 76 and 77 thereby resulting in basically a captive area display since it operates within a discrete area between two concentric circles. Accordingly, it is possible to put other patterns and designs inside or outside the area defined by the captive area utilized by this pattern. It is preferable that the perforations in row A be of a different diameter than the perforations in row B, which allows each row or ring to be separately observed as they pass through each other. There is shown in FIG. 8 a design type which is somewhat different than those previously shown, since each perforation unit is centered about a single concentric circle. For example, the four holes 82, 83, 84 and 85, are clustered about a center point 86. Likewise, perforation 87 has at its center point 88 and the two points 86 and 88 are on the same concentric circle. Upon rotation of body 81 in the presence of the pulsating light source, a unique interaction takes place between the four clustered holes and the one large hole wherein at certain speeds of rotation the cluster appears to be centered within the large hole and at other points of rotation the cluster appears to have a small hole within the center, and again at other speeds of rotation the large holes are appeared to be joined by a daisy chain. The motion in this particular design does not occur along a radial but instead occurs along the line of a single concentric circle, passing through points 86 and 88. Due to the fact that motion of this particular pattern is circumferentially oriented, as opposed to radially oriented, it is a good pattern to use in between two radially oriented patterns, such as, the bouncing design of FIG. 6 and a saw tooth design such as shown in FIG. 4, if it is desired to maintain a clear line of demarcation between the operation of the various patterns as they pass through their different illusionary phases at the various speeds of rotation. FIG. 9 depicts rows A, B, C and D, each row comprised of perforations having a center on a specific concentric circle. The progressive size of the hole in each of the rows is apparent and the effect produced upon rotation is a blinking effect as the hole appears to gradually increase in diameter and then decrease in diameter. By using fewer holes more widely spaced apart, instead of a blinking effect a bursting effect will be produced. Although four rows are shown here, it is possible to simply use one row in a pattern system and since again the motion does not proceed along a radial, it is a useful design for use in conjunction with radial patterns so as to provide a variety of visual effects during the course of observing a rotating body.

Figure 10:
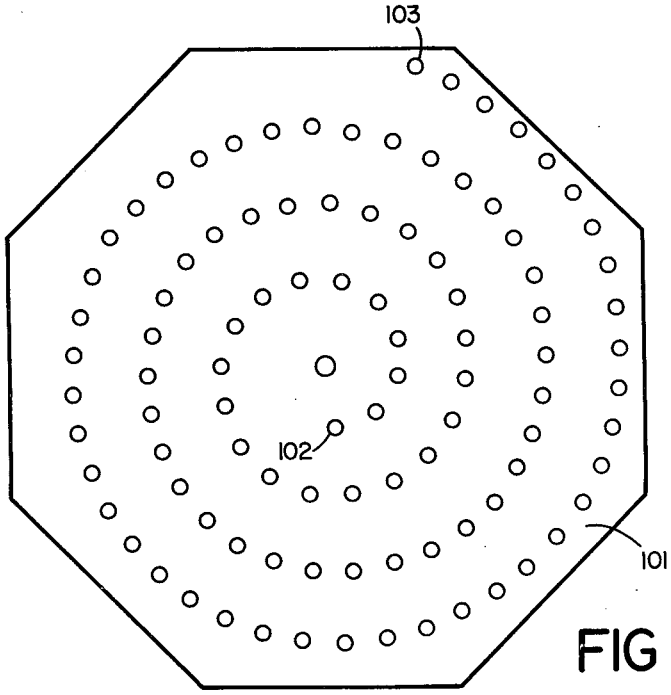
FIG. 10 sets forth a pattern which will produce a spiral effect.

The designs shown heretofore are generally of a type which consume only a specific area on the disc since they are either operating within a captive area as defined by two concentric circles, or operate in a finite location along a single concentric circle. However, in FIG. 10 a different type of design which operates over a broad area of the body is shown. Here body 101 contains a series of perforations with a beginning point at perforation 102 and an ending point at perforation 103, with the first point near the center of the body 101, and the last perforation 103 being at the outer edges thereof. Here the perforation pattern operates on an ever increasing radial distance while a fairly uniform arc distance or degree coordinate is maintained. Upon rotation of body 101 and the influence of a pulsating light, an unusual spiral effect is created. One interesting illusion of this spiral is that it appears to emerge out of a row of holes evenly placed on a concentric circle thereby creating an interesting and intriguing illusion. Spirals may be varied in a number of ways. For example, one variation is for a spiral to proceed outwardly for approximately one-half the distance and then reverse direction and head back inward toward the center of the body. Further variation is for the spiral to proceed to approximately one-half or one-third of the distance and then reverse directions as it proceeds in an outwardly fashion. Although the spiral could be used at an interim point in the body between two concentric circles, the most desirable effects are produced when the perforation having the shortest radial distance is fairly close to the center of the body. However, since the bodies can be made of any diameter, it is possible to have a spiral in the inner area of the body with various other designs beyond the area where the spiral is in motion.

The foregoing discussion of various patterns is intended to provide one skilled in the art with exemplary schemes to produce interesting illusionary effects. References have been made to radial distances, radial coordinates, arc distances, degree coordinates, captive area of activity, finite area of activity, broad area of activity, etc. These terms are not intended to impart any scientific or theoretical significance but are only for the purpose of explaining in a general way how the perforations are to be located in order to produce the desired effects. One skilled in the art after making a number of patterns in accordance with the teachings above will be able to interpolate and extrapolate to other designs which will likewise produce an unusual occular stimulation. Although it has been described above that certain patterns operate within a captive area, it not intended that no other pattern can operate within the same captive area, and it is entirely possible to overlap certain patterns in order to produce more complex and intriguing displays. Since the preferred embodiment involves variable rotational speeds of the body in conjunction with a constant pulsating light source, a wide variety of mental perceptions and apparent patterns will result if a wide variety of speeds of rotation are utilized. Patterns at one moment will be extremely vivid in their display then become somewhat subdued and then suddenly burst into a new design or display. Movements will suddenly shift direction or accelerate from an apparent still position. Often times a pattern laid out in accordance with the principles set forth above will produce, when actually used, design illusions which are totally unexpected. It will be quickly realized by one skilled in the art that a single row of holes properly placed can produce at least a dozen different illusion designs at the various speeds of rotation. Although it has been attempted to explain to some extent the illusions produced by observing the various patterns and the bodies described above in the presence of a pulsating light source, the actual kinematics phenomenon defies verbal description as is the case in many matters involving sensual perception. Accordingly, the full appreciation of the unusual visual display created by the teachings herein, cannot be comprehended without actually observing the invention in actual use.

Figure 11:
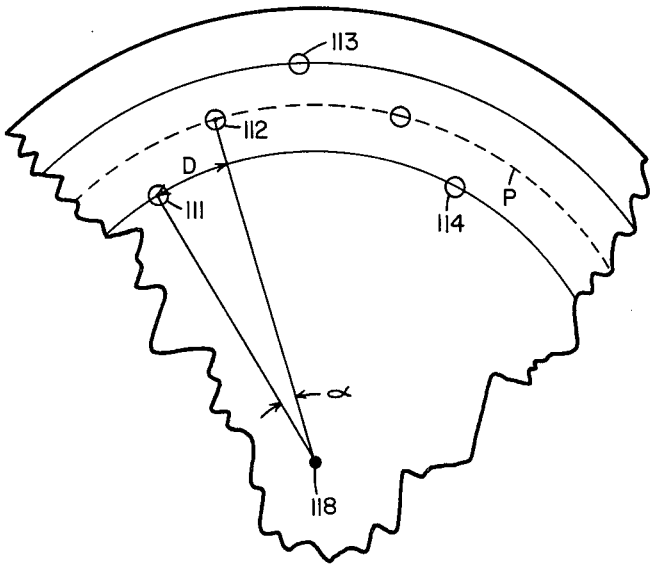
FIG. 11 is a partial cross-section showing various parameters and coordinates for describing pattern styles.

In order to permit a more complete comprehension of the present invention, the various detailed principles above will be reviewed. Referring to FIG. 11, there is shown a cut-away portion of the rotating body showing some of the basic parameters and coordinates referred to herein. Component 111 is located a specific radial distance from the center 114 of the body, which distance is called the radial coordinate. The arc distance from component 111 to component 112 is a specific portion of a circle measurable in degrees, which arc distance is called the degree coordinate so as to show lateral or circumferential displacement as opposed to radial displacement. Depicted here is a pattern style involving a captive area, and components 113 and 114 are on the concentric circles that establish the boundary limits of the captive area. The concentric circle through 113 is the outer limiting concentric circle and the concentric circle through component 114 is the inner limiting concentric circle. In a saw tooth, sign wave, or undulating pattern area, the central axis about which the movement takes place is approximately midway between the limiting concentric circles and is referred to as the prime concentric circle P.

Figure 12:
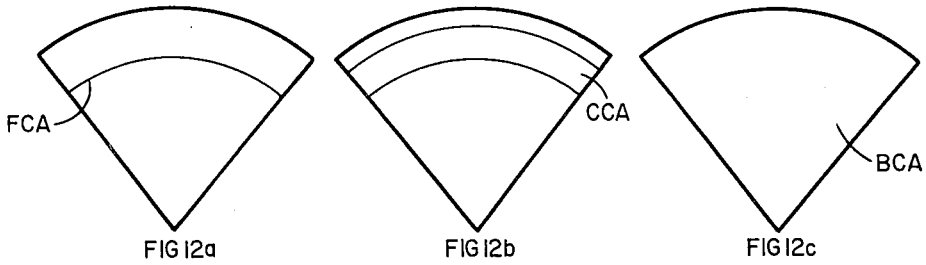
FIG. 12 is a partial cross-section showing the three basic pattern areas.

Referring now to FIG. 12, three cut-away portions of a rotating body are shown to illustrate the area of activity of a particular pattern style. FIG. 12*a* depicts a finite pattern area referred to above wherein the components are aligned generally along one concentric circle. The examples of styles falling into the finite area category are the blinking and bursting pattern styles.

FIG. 12*b* shows the captive area referred to above and the components thereof described in FIG. 11. Examples of styles falling into the captive area category are the saw tooth, undulating and bouncing pattern styles.

FIG. 12*c* shows the broad area situation referred to above when the components range over a broad area across the face of the body. An example of a pattern style fitting into the broad area category is a spiral wherein the motion is circumferentially oriented as well as radially oriented.

Since the present invention is based on a sensory phenomenom, exact and precise definitions of the phenomenom are not available. Accordingly, certain definitions are set forth hereinafter for the purpose of permitting some clarity and uniformity in analyzing the optical phenomenom herein described. These definitions are intended as aides to understanding only and are not purported to be exhaustive in the treatment of this phenomenom or an attempt at its scientific or theoretical explanation.

Pattern area: the area of activity and motion of a pattern style, which area usually covers a finite, captive or a broad area, which areas are discussed above with respect to FIG. 12. Usually a single pattern style will be located within one pattern area. Pattern unit: one unit of components which by itself creates one single impression on the retina. At least two pattern units are required to give the visual perception of movement when the first unit is illuminated at one specific station of ocular view, and the second unit is subsequently illuminated at or near the same station or at a predetermined position therefrom. For example, in FIG. 6 set number 1, designated as S1 is a pattern unit.

Pattern components: the various individual components or perforations that make up a pattern unit. For example, the pattern components in FIG. 6 are the seven holes shown in set number 1, designated as S1.

Central component: the pattern component that is the center point of action. For example, in FIG. 6 the central hole shown in the center of set number 1, designated as S1. Another example is shown in FIG. 3 wherein pattern component 36 is the central component in the pattern unit.

Planetary components: pattern components which move with respect to the central component by rotational movement, linear movement, eccentric movement or other movements about the central unit component. By definition the planetary components move within the confines of the pattern area which is usually a captive area. An example of planetary components are components 37, 38 and 39 in FIG. 3 and the six components depicted as the small perforations in set number 1, designated as S1 in FIG. 6.

Repeating pattern: a pattern style wherein the pattern unit repeats itself at least once in one full circle. An example is the sign-wave pattern of a saw tooth or undulating configuration as shown in FIG. 4. Another example is a blinking and bursting configuration where the gradual hole size change along a concentric circle repeats itself at least once within a full circle.

Alternative component pattern: usually a pattern unit where no central component exists. Instead two or more discrete components or clusters of components are viewed during rotation as in juxtaposition to, overlapping with or superimposed on another. Another example is shown in FIG. 8 wherein the large circle and the cluster of four small circles are alternative components.

Pattern styles: the various overall patterns placed in a pattern area, such as, the sixteen pattern units or sets as shown in FIG. 6, an alternative component pattern style as shown in FIG. 8, or a repeating pattern.

Dynamic pattern: the multitudes (i.e., two or more) of patterns visually perceived during the rotation of a single pattern area and in accordance with the teachings of the present invention.

Dynamic pattern array: the panoramic display of two or more dynamic patterns at the same time.

Although the above treatment is not exhaustive of the various pattern styles that the present invention is susceptible of, it is sufficient to show those skilled in the art the basic concepts from which other variations may be made. It will be obvious to those skilled in the art that certain variations may be employed without departing from the spirit of the invention hereof. For example, it is possible to use multiple pulsating light sources so that certain areas may be illuminated by pulses at different rates in other areas. This may be done by pattern areas, quadrants or any other area desired. Moreover, it is possible to take a disc and add to the outer circumference thereof a disc annulus which can be rotated in a different direction or at a different speed in the same direction containing independent pattern areas and pattern styles. Although it is usually preferable to maintain either the rotational speed of the body or the pulsating rate of the light source, it is possible to vary the rate of rotation as well as the rate of pulsation in order to create a wider variety of kinematic optical sensations. When a disc containing perforations is involved, the perforations need not be circular as shown in the drawings above but could be any other form, such as, square, rectangular, elliptical, etc. The body, of course, can be formed from a number of materials, such as, bakelite, masonite, plastics and the like, and the components can be imparted thereto by either drilling, casting, punching, etc. The components can be perforations or small reflective surfaces, such as, small mirror-liked discs of circular, rectangular or other shape. Such a configuration would be useful for projecting an image onto a screen or ceiling. Also, it is normally desirable to have the light source impinging basically at an angle normal to the surface of the body, however, angles other than right angles may be used in order to produce additional optical effects. Aside from the pleasing visual effect, an intriguing and attention-grasping effect of the illusion is created by the present invention. Illusions can also have the effect of producing a soothing or calming effect. For example, they could be used in hospital rooms by projecting the dynamic array onto the ceiling above the patient who could be entertained or relaxed by the intriguing motions thereof. For patients in considerable pain, it would be a device that would have a beneficial soothing effect when certain dynamic pattern arrays are used.

Many modifications may be made by those who desire to practice the invention herein without departing from the scope hereof which is defined by the following claims.

I claim:

1. An improved optical amusement device of the class consisting of a light source pulsating at a constant rate and in optical alignment therewith a disc containing perforations, said disc rotating about a central axis at variable rotational speeds, the improvement comprising a disc containing perforations in at least one area, each such area involving a definitive area of said disc within a first predetermined radial distance and a second predetermined radial distance from said central axis defining a captive area of motion whereby light from the light source passing through said perforations produces the optical effect of dynamic motion within said captive area wherein at least a portion of said perforations are the repeating pattern style.

2. An improved optical amusement device of the class consisting of a light source pulsating at a constant rate and in optical alignment therewith a disc containing perforations, said disc rotating about a central axis at variable rotational speeds, the improvement comprising a disc containing perforations in at least one area, each such area involving a definitive area of said disc within a first predetermined radial distance and a second predetermined radial distance from said central axis defining a captive area of motion whereby light from the light source passing through said perforations produces the optical effect of dynamic motion within said captive area wherein at least a portion of said perforations are the alternative component pattern style.

3. An improved optical amusement device of the class consisting of a light source pulsating at a constant rate and in optical alignment therewith a disc containing perforations, said disc rotating about a central axis at variable rotational speeds, the improvement comprising a disc containing perforations in at least one area, each such area involving a definitive area of said disc within a first predetermined radial distance and a second predetermined radial distance from said central axis defining a captive area of motion whereby light from the light source passing through said perforations produces the optical effect of dynamic motion within said captive area wherein at least a portion of said perforations are the combined central and planetary component pattern style.

4. An improved optical amusement device of the class consisting of a light source pulsating at a constant rate and in optical alignment therewith a disc containing perforations, said disc rotating about a central axis at variable rotational speeds, the improvement comprising a disc containing perforations in at least one area, each such area involving a definitive area of said disc within a first predetermined radial distance and a second predetermined radial distance from said central axis defining a captive area of motion whereby light from the light source passing through said perforations produces the optical effect of dynamic motion within said captive area wherein at least some of said perforations are arranged in a series at a uniform radius from said central axis and wherein the size of said perforations in said series increase progressively.

* * * * *